US006322354B1

(12) United States Patent
Carbone et al.

(10) Patent No.: US 6,322,354 B1
(45) Date of Patent: Nov. 27, 2001

(54) STACKED DUAL GAS BURNER

(75) Inventors: Philip Carbone, North Reading; Judith Reich, North Andover; Steven Hobson, Arlington, all of MA (US); Amnon Bar-Ilan, Berkeley, CA (US); Matthew Brekken, Boston, MA (US)

(73) Assignee: Wolf Appliance Company, LLC, Fitchburg, WI (US)

( * ) Notice: Subject to any disclaimer, the term of this patent is extended or adjusted under 35 U.S.C. 154(b) by 0 days.

(21) Appl. No.: 09/619,079

(22) Filed: Jul. 17, 2000

(51) Int. Cl.[7] ..... F23Q 9/00

(52) U.S. Cl. ..... 431/284; 431/278; 431/349; 126/39 R; 126/39 E; 239/549; 239/553.5; 239/558

(58) Field of Search ..... 126/39 R, 41 R, 126/39 E, 39 J, 39 K; 431/12, 278, 181, 350, 284, 266, 349, 354; 239/553.5, 555, 554, 548, 549, 553, 556–561, 567, 568

(56) References Cited

U.S. PATENT DOCUMENTS

| | | |
|---|---|---|
| 3,627,462 | 12/1971 | Lotter . |
| 3,754,853 | 8/1973 | Braucksiek et al. . |
| 3,796,535 | 3/1974 | De Gouville . |
| 3,817,689 | 6/1974 | Capy . |
| 3,825,398 | 7/1974 | Katchka et al. . |
| 3,840,330 | 10/1974 | Katchka . |
| 3,870,458 | 3/1975 | Hendrick . |
| 4,827,898 | 5/1989 | Liao et al. . |
| 5,139,417 | 8/1992 | Ghassemzadeh . |
| 5,224,855 | 7/1993 | Toyonaga et al. . |
| 5,277,576 | 1/1994 | Hartung . |
| 5,342,192 | 8/1994 | Hirano . |
| 5,488,942 | 2/1996 | Maughan . |
| 5,490,778 | 2/1996 | Meijer . |
| 5,649,822 | 7/1997 | Gertler et al. . |
| 5,765,542 | 6/1998 | Fey et al. . |
| 5,899,681 | 5/1999 | Maughan . |
| 5,915,956 | 6/1999 | Kwiatek et al. . |

FOREIGN PATENT DOCUMENTS

| | | | |
|---|---|---|---|
| 80253/94 | | 6/1995 (AU) . | |
| 19905198 | | 8/2000 (DE) . | |
| 3346929 | * | 7/1985 (DE) ..... | 126/39 R |
| 064725 | | 11/1982 (EP) . | |
| 485645 | | 5/1992 (EP) . | |
| 534301 | | 3/1993 (EP) . | |
| 61-86517 | * | 5/1986 (JP) ..... | 126/39 R |
| 3-144206 | * | 6/1991 (JP) ..... | 126/39 R |

* cited by examiner

*Primary Examiner*—James C. Yeung
(74) *Attorney, Agent, or Firm*—Foley & Lardner

(57) ABSTRACT

A stacked dual gas burner which achieves good performance at high firing rates as well as good simmer performance at low firing rates. The stacked dual gas burner includes a main burner and a second (simmer) burner. The main burner and second burner are positioned in a stacked relation in a burner assembly, with the second burner positioned coaxially with and below the main burner. The second burner radius is smaller than the main burner radius, such that a portion of the main burner overhangs the second burner adjacent to the second burner ports. Recirculation underneath the overhanging edge of the main burner above the simmer burner ports helps maintain flame attachment at the second burner ports. A valve may be used to provide separately controllable flows of fuel to each of the main and second burners.

28 Claims, 3 Drawing Sheets

STACKED DUAL GAS BURNER

FIELD OF THE INVENTION

The present invention pertains generally to gas burners of the type employed for cooking appliances such as gas cook tops, and more particularly to dual burners including separate main and simmer burner ports.

BACKGROUND OF THE INVENTION

A conventional gas cooking appliance, such as a gas cook top, includes a plurality of gas burners arranged in an array on the cook top. The burners are supplied from a manifold connected to a source of fuel gas, with individual user operated valve control dials for regulating the flow of gaseous fuel to the individual burners. Food to be cooked is placed in receptacles, e.g., pots and pans, which are positioned over the burners on the gas cook top.

Typical gas burners have an annular or generally ring-shaped configuration, with flame-generating ports disposed peripherally around the burner to provide a ring of discrete flames emanating from the burner ports when the user operates a control valve to provide a flow of gas to the burner. (The burner flame may be ignited by a continually burning pilot flame positioned in or near the burner or, more commonly, by an electrical flame ignition.) One limitation of such conventional burners is that they cannot provide a wide range of heating capability, ranging from very high firing rates (low-time-to-boil) to low (simmer) capability. If the burner ports are made large, to accommodate a high gas flow therethrough for providing high output, the flame provided by such ports will extinguish if the gas flow is reduced too much. Similarly, if the burner ports are made small, to support a low firing rate, for simmering, the flow through the burner ports will be restricted, causing the flames to lift off at higher gas flow levels, thereby limiting high firing rate capability of the burner.

A conventional dual gas burner attempts to achieve both good high firing rate and simmer performance by utilizing two burner rings in each burner. Concentric main and simmer burners are provided, with the main outer and larger burner having more and larger burner ports than the burner ports provided in the smaller and inner simmer burner. Gas flow to the main and simmer burners is controlled to provide high firing rates by providing gas flow at relatively high rates to the main burner, and low firing rates, for simmering, by providing gas flow at a lower rate to the simmer burner. In such configurations, the small inner burner has very good convective heat transfer to a container located over the burner in which food to be cooked is placed, thereby raising the effective simmer temperature. Simultaneously, the larger outer burner ring has poor convective heat transfer to the cooking container, thus increasing time to boil at high firing rates. Thus, this conventional burner configuration in itself is of limited effectiveness, providing more heat to a cooking container when it should be providing less (during simmering), and less heat when it should be provide more (at high firing rates).

Another method which has been used to achieve good simmer performance may be employed with a single conventional burner ring. To achieve low output from such a burner, without unintentional loss of flame, gas flow is maintained at a level to keep the flame burning, but the gas flow is cycled on and off at a low duty cycle to keep temperatures minimized. Shutting off the gas flow for variable short periods of time can reduce the average heat output below that output possible with the control of only the continuous flow rate, thereby providing good simmer performance. However, such burners require an additional control system and added hardware which increases the manufacturing costs and reduces the reliability of gas cook tops employing such burners. Also, the cyclic nature of the burner operation can be less safe than other methods.

What is desired, therefore, is a low-cost gas burner for a gas cook top or other gas cooking appliance which can achieve good performance (low-time to-boil, high efficiency, and low emissions) at high firing rates as well as good simmer performance at low firing rates.

SUMMARY OF THE INVENTION

The present invention provides a stacked dual gas burner which achieves good performance at high firing rates as well as good simmer performance at low firing rates. A stacked dual gas burner in accordance with the present invention achieves this wide range of operation by integrating a large main burner and slightly smaller second (simmer) burner into a single burner assembly. The control of gas flow to the burner assembly is provided by a valve, e.g., a two-stage valve. The main and second burners are positioned with respect to each other in the burner assembly so as to provide for recirculation above the simmer burner ports, to maintain flame attachment at the simmer burner ports even at very low gas flow levels. The main burner and second burner may be provided together as a single integrated piece, or as two separate pieces which are assembled together in a burner assembly.

A stacked dual gas burner in accordance with the present invention includes a main burner and a second (simmer) burner. The main burner and second burner may be provided together as a single integrated piece, or as two separate pieces which are assembled together in a burner assembly. The main burner and second burner are positioned in a stacked relation in the burner assembly, with the second burner positioned coaxially with and below the main burner in the burner assembly. The main burner may have a generally circular configuration, with a first radius, and have a plurality of main burner ports formed on an outwardly facing radial surface thereof. The second burner, positioned below the main burner, is preferably also circular in shape, with a second radius, and has a plurality of second burner ports formed on an outwardly facing radial surface thereof. The second burner radius is preferably smaller than the main burner radius, such that a portion of the main burner overhangs the second burner adjacent to the second burner ports. The overhanging portion of the main burner provides for stabilization of flames provided at the second burner ports. Recirculation underneath the overhanging edge of the main burner above the simmer burner ports helps maintain flame attachment at the second burner ports.

The main burner ports are preferably round in shape and may be grouped into clusters of burner ports wherein the distance between burner ports within a cluster is smaller than the distance between clusters. The second burner ports on the second burner may be either round in shape or have a slot design. The second burner ports may also include a plurality of pairs of burner ports, wherein one of the burner ports in each pair is positioned above another of the burner ports in each pair. The main burner ports in the main burner are larger than the second burner ports in the second burner. The relative sizes of the ports in the two burners are preferably designed to minimize the step change in performance which occurs when switching between the sets of ports. The main ports in the main burner and the second ports in the second burner may be aligned radially with each other. The main burner preferably also may include secondary main burner ports formed therein adjacent to the main burner ports. The secondary main burner ports are preferably smaller than the main burner ports, and reduce port loading for greater flame stability at high firing rates (especially for a cold burner) and enhance flame carryover between the burner ports.

The flow of gas to the burner assembly is preferably controlled by a two-stage valve. When the valve is turned by different amounts, the flow of fuel to the second and main burner ports is controlled at various levels. Preferably, the fuel provided to the main burner is a partially pre-mixed gas-air mixture. The second burner is preferably a diffusion flame burner, for enhanced flame stability.

A stacked dual gas burner in accordance with the present invention achieves several advantages over conventional dual burners and other gas burners. By positioning the second burner below the main burner, simmer flames from the second burner are moved away from a cooking container, thereby reducing heat transfer from the second burner relative to the main burner. Since the second burner is positioned below the main burner, and not merely concentrically thereto, the relative diameter of the main burner can be decreased and the relative diameter of the second burner increased, thereby further reducing convective heat transfer to a container from the second burner and increasing convective heat transfer to a container from the main burner. By providing a main burner which overhangs the second burner ports of a second burner, recirculation underneath the overhanging edge of the main burner adjacent to the second burner ports is provided, which stabilizes simmer burner flames provided by the second burner ports, thereby maintaining flame attachment at the second burner ports even at very low gas flow levels. A stacked dual gas burner in accordance with the present invention also produces minimal CO, due to a large amount of air provided underneath both the main and second burners, providing sufficient burn-out, and operation in natural draft mode. A single igniter can be used to ignite either burner, further minimizing the cost of the burner assembly in accordance with the present invention.

Further objects, features, and advantages of the present invention will be apparent from the following detailed description taken in conjunction with the accompanying drawings.

DETAILED DESCRIPTION OF THE INVENTION

Figure 1:
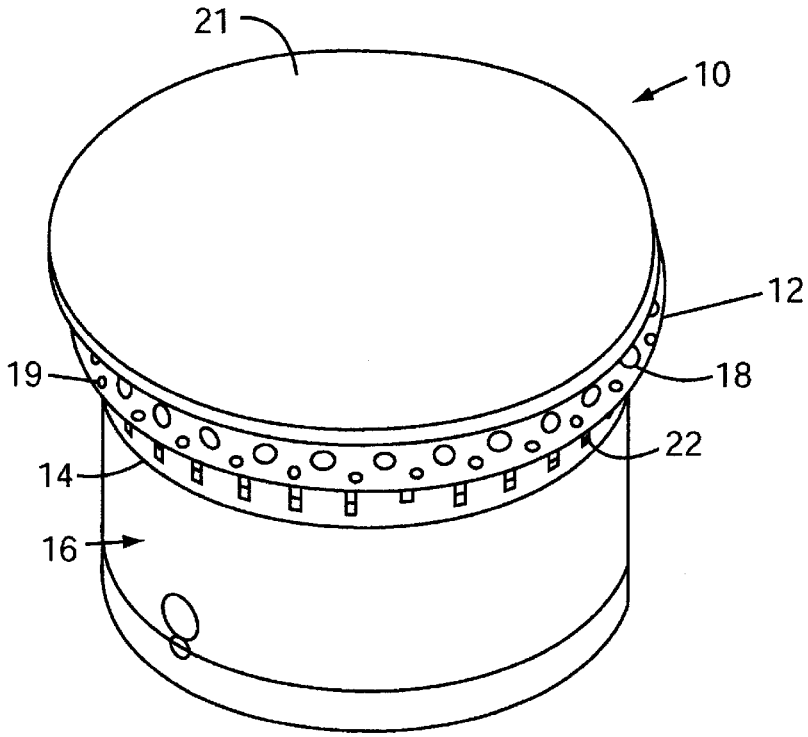
FIG. 1 is a perspective view of an exemplary stacked dual gas burner in accordance with the present invention.

An exemplary stacked dual gas burner 10 in accordance with the present invention will be described in detail with reference to FIGS. 1–4. A stacked dual gas burner 10 in accordance with the present invention includes two burners, a main burner 12 and a second or simmer burner 14. The main 12 and second 14 burners are stacked together, along with a base portion 16, to form the stacked dual gas burner assembly 10. (Note that the main burner 12 and second burner 14 may be provided together as a single integrated piece, or as two separate pieces which are assembled together in the burner assembly 10.) One or more such assemblies 10 may be mounted in a conventional manner in a gas cooking appliance, such as a gas cook top. The main burner 12 and second burner 14 are preferably circular in configuration. (Although the main burner 12 and second burner 14 may have other than a circular shape, the main burner 12 and second burner 14 preferably have the same shape.)

The main burner 12 includes a plurality of main burner ports 18 formed on a radially outward facing surface thereof. The main burner ports 18 are preferably round in shape. The main burner ports 18 may be evenly spaced around the main burner 12, or grouped into clusters. For example, the main burner ports 18 may be grouped into four clusters, wherein the distance between each burner port 18 within a cluster is smaller than the distance between clusters. Secondary main burner ports 19 preferably may also be formed on the radially outward facing surface of the main burner 12, adjacent to the main burner ports 18. The secondary main burner ports 19 are preferably smaller than the main burner ports 18, and are positioned on the radially outward facing surface of the main burner 12 between, and preferably slightly below, the main burner ports 18. The secondary main burner ports 19 reduce port loading for greater flame stability (especially for a cold burner) and enhance flame carryover between the burner ports. As shown, e.g., in FIG. 3, the main burner 12 may be formed as a main burner ring 20, having the main burner ports 18 (and secondary main burner ports 19) extending therethrough from an outside thereof to an inside thereof, and a cover portion 21, enclosing the top of the main burner ring 20. The bottom of the main burner ring 20 is thus left open. The cover portion 21 of the main burner 12 may have a larger radius than, and thus extend over, the main burner ring 20.

Figure 2:
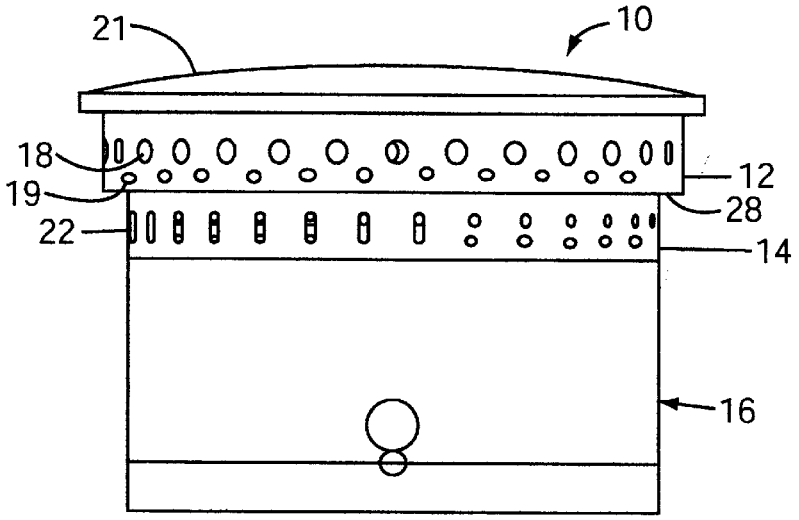
FIG. 2 is a side view of the exemplary stacked dual gas burner of FIG. 1.
Figure 3:
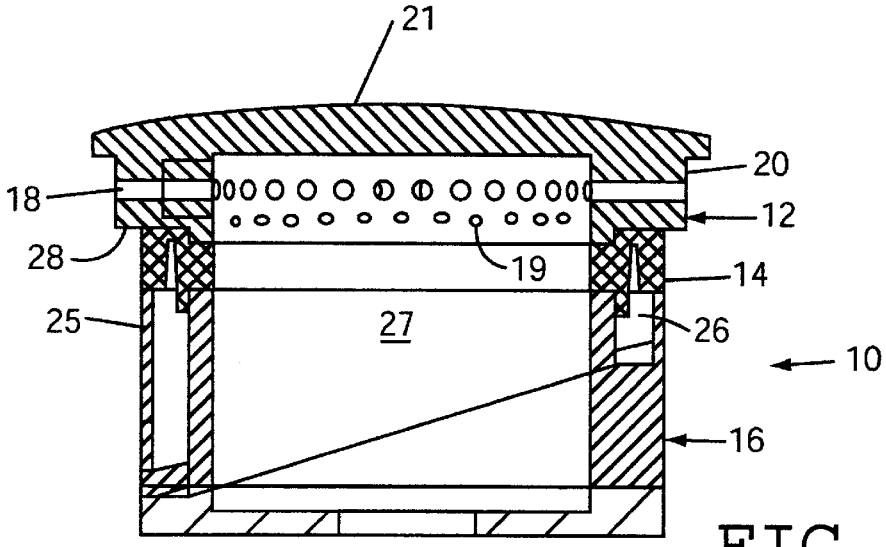
FIG. 3 is a first side cross-sectional view of the exemplary stacked dual gas burner of FIG. 1.
Figure 4:
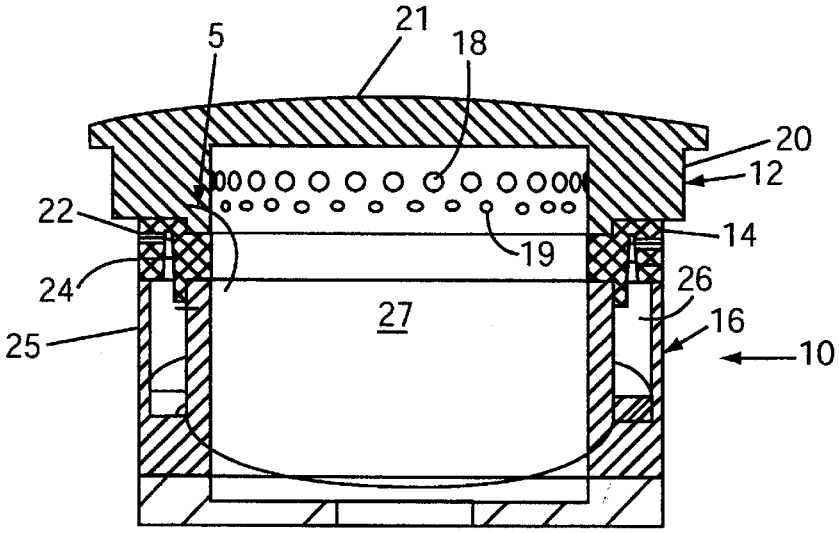
FIG. 4 is a second side cross-sectional view of the exemplary stacked dual gas burner of FIG. 1.
Figure 5:
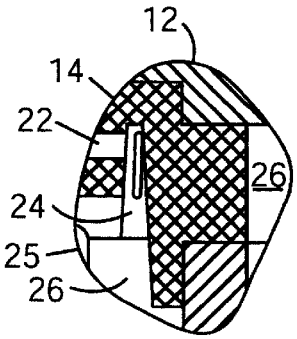
FIG. 5 illustrates in detailed cross-section a portion of the stacked dual gas burner illustrated in FIG. 4.

The second burner 14 includes a plurality of second burner ports 22 formed on a radially outward facing surface thereof. The second burner ports 22 may have either a round or slot shaped design. The round second burner ports 22 may be provided as dual round second burner ports, i.e., pairs of round burner ports with one of the burner ports in each pair positioned above the other. (Both dual round and slot shaped second burner ports 22 are illustrated in FIG. 2 on a single stacked dual gas burner 10 for exemplary purposes only. In real world applications, the second burner ports 22 on a single stacked gas burner assembly 10 are preferably either round or slot shaped in configuration, not both.) As shown in FIG. 4, and in more detail in FIG. 5, the second burner 14 is preferably formed as a ring. The second burner ports 22 preferably extend into the second burner ring and are in fluid communication with a circumferential channel 24 formed in the second burner ring 14. The circumferential channel 24 preferably opens downward.

The main burner 12 and second burner 14 may have the same number of burner ports 18 and 22, respectively, with the main 18 and second 22 burner ports aligned radially with each other in the stacked dual gas burner assembly 10. The main burner ports 18 are preferably larger than the second burner ports 22, with the relative sizes of the ports in the two burners selected to minimize the step change in performance which occurs when switching between the two sets of ports.

A distribution ring 25 is provided below the second burner ring 14. The distribution ring 25 has a U-shaped cross-section, forming a channel 26 in fluid communication with the circumferential channel 24 of the second burner ring. As will be discussed in more detail below, a flow of gas is provided into the circumferential channel 24 and out of the second burner ports 22, via the channel 26 in the distribution ring 25, for providing, e.g., simmer flames from the second burner ports 22. Note that the floor of the U-shaped cross-section is preferably sloped to improve proper gas distribution through the channel 26 (see FIG. 3).

In accordance with the present invention, the main burner 12 and second burner 14 are mounted together (or formed in a single piece) in a stacked relationship on the base portion 16 to form the stacked dual gas burner assembly 10. For example, as illustrated, the main burner 12 is positioned coaxially with and on top of or above the second burner 14. The second burner ring 14 is, in turn, placed on top of the distribution ring 25, such that the distribution ring channel 26 is in fluid communication with the circumferential channel 24 in the second burner ring. The stacked first 12 and second 14 burner rings, and distribution ring 25, are mounted on the base portion 16 such that the base portion 16 and the inside surfaces of the first burner 12, second burner 14, and distribution ring 25 form a central main fuel chamber 27.

The changes made to the foregoing paragraph of the specification from the paragraph as originally filed is shown on a separate sheet attached hereto.

The main burner 12 has a radius which is larger than the radius of the second burner 14, such that when the main burner 12 is positioned over the second burner 14 in the burner assembly 10, an extending edge 28 of the main burner 12 extends radially outward beyond the outer periphery of the second burner 14 adjacent to the second burner ports 22. Thus, the overhanging edge 28 of the main burner 12 extends radially outward beyond the second burner ports 22 formed in the second burner 14. As will be discussed in more detail below, this extending portion 28 of the main burner 12 provides for recirculation, which stabilizes the flames produced from the second burner ports 22, thereby helping to maintain flame attachment at the second burner ports 22 even at low simmer levels. To provide for such recirculation, the relative sizes of the main 12 and second 14 burners are selected such that the main burner edge 28 extends over the second burner 14 by an amount of, e.g., approximately ⅛". This provides enough overhang 28 to provide recirculation, while maintaining the relative sizes of the main 12 and second 14 burners relatively similar. Thus, the relative size of the main burner 12 may be reduced and the second burner 14 increased, for a given burner size, to improve convective heat transfer from the main burner 12 while reducing convective heat transfer to a container placed above the burner 10 from the second burner 14. Positioning the second burner 14 below the main burner 12 also increases the distance between the second burner ports 22 and a container placed above the burner. This further reduces the amount of heat that is provided from the second burner 14 to the container. These features, in combination, allow a stacked dual gas burner in accordance with the present invention to achieve a very high turndown ratio. For example, a turn-down ratio of up to 12 to 1 may be achieved with a stacked dual gas burner in accordance with the present invention.

Figure 6:
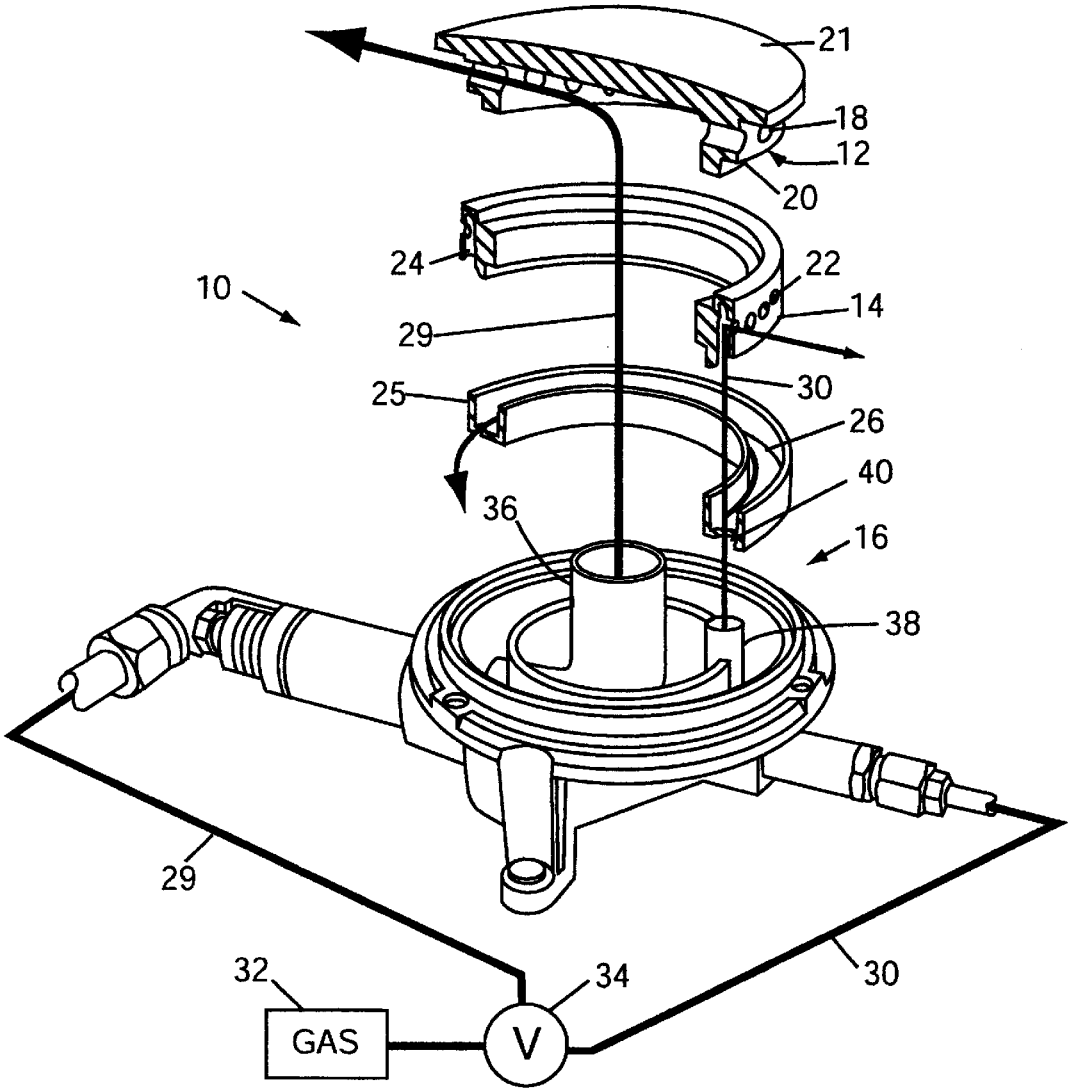
FIG. 6 is an exploded perspective view of an exemplary stacked dual gas burner in accordance with the present invention.

Operation of a stacked dual gas burner 10 in accordance with the present invention, to provide a wide range of performance from a very high firing rate (low-time-to-boil) to low simmer operation will now be described in detail with reference to FIGS. 3–6. As shown in FIG. 6, in accordance with the present invention, separate flows of gaseous fuel 29 and 30 are provided to the main 18 (and secondary main 19) and second 22 burner ports, respectively. The flow of fuel 29 through the main burner ports 18 (and secondary main burner ports 19) is larger than the maximum flow of fuel through the second burner ports 22. Thus, the main burner ports 18 (and secondary main burner ports 19) on the main burner 12 are used for high firing rate operation, to provide high temperature and rapid heating of a container placed above the burner 10, and the second burner ports 22 in the second burner 14 are used to provide low firing rate operation, e.g., for simmering.

The main 29 and second 30 gaseous fuel flows are preferably provided from a gas source 32. The gas source 32 may, for example, be a gas supply manifold in a gas cooking appliance, such as a gas cook top, which is provided, e.g., natural gas, propane, or some other gaseous fuel from a conventional source. Gas from the gas supply 32 is provided to a valve 34, which may be controlled by an operator to control the main fuel flow 29 through the main burner ports 18 (and the secondary main burner ports 19) and the second fuel flow 30 through the second burner ports 22. The valve 34 is preferably a conventional two-stage valve, which allows the main 29 and second 30 fuel flows to be controlled. For example, the valve 34 may be used to control the second fuel flow 30 and the main fuel flow 29 by turning the valve by different amounts in one direction.

The main 29 and second 30 gas flows are provided from the valve 34 via conventional conduits 36 and 38, respectively, into the base portion 16 of the gas burner assembly 10. The main fuel conduit 36 opens in fluid communication with the central fuel chamber 27, which, in turn, is in fluid communication with the main burner ports 18 (and secondary main burner ports 19) in the main burner 12. Thus, the main fuel flow 29 is provided to the main burner ports 18 (and secondary main burner ports 19) via the central fuel chamber 27 formed in the burner assembly 10. Fuel entering the central fuel chamber is preferably a partially premixed gas-air mixture, which may be provided by a conventional venturi structure provided along the main fuel conduit 36.

The second fuel conduit 38 opens in fluid communication with the channel 26 formed in the distribution ring (via an aperture 40 formed in the bottom of the distribution ring). Gas from the second fuel flow 30 thus diffuses around the distribution ring 25, into the circumferential channel 24 formed in the second burner ring 14, which is in fluid communication therewith, and out of the second burner ports 22. Thus, the second fuel flow 30 is provided to the second burner ports 22 via the distribution ring channel 26. Thus, the second burner 14 is preferably operated as a diffusion flame apparatus, for enhanced flame stability. The sloping floor of the distribution ring channel 26 ensures proper distribution of fuel among the second burner ports.

It is understood that the present invention is not limited to the particular embodiments, examples, and applications illustrated and described herein, but embraces all such modified forms thereof as come within the scope of the following claims.

What is claimed is:

1. A stacked dual gas burner assembly, comprising:

(a) a main burner having a main burner radius and a plurality of main burner ports formed on a radially outward facing surface thereof;

(b) a second burner having a second burner radius and a plurality of second burner ports formed on a radially outwardly facing surface thereof, wherein the second burner is positioned coaxially with and below the main burner in the gas burner assembly, and wherein the second burner radius is smaller than the main burner radius such that an overhanging edge of the main burner overhangs the second burner adjacent to the second burner ports to provide recirculation underneath the overhanging edge to stabilize flames produced from the second burner ports to help maintain flame attachment at the second burner ports.

2. The gas burner assembly of claim 1 wherein the main burner overhangs the second burner by approximately ⅛ of an inch.

3. The gas burner assembly of claim 1, comprising additionally means for providing separately controllable flows of gas to each of the main burner ports and the second burner ports.

4. The gas burner assembly of claim 3 wherein the means for providing a flow of gas to the main burner ports includes means for providing a partially pre-mixed gas-air mixture to the main burner ports.

5. The gas burner assembly of claim 3 wherein the means for providing separately controllable flows of gas to each of the main burner ports and the second burner ports includes means for providing a flow of gas to the main burner ports and to the second burner ports but not to both the main and second burner ports simultaneously.

6. The gas burner assembly of claim 3 wherein the means for providing separately controllable flows of gas to each of the main burner ports and the second burner ports includes a two stage-valve.

7. The gas burner assembly of claim 1 wherein the main burner ports are round and the second burner ports are round.

8. The gas burner assembly of claim 1 wherein the main burner ports are round and the second burner ports are slot shaped.

9. The gas burner assembly of claim 1 wherein the second burner ports include a plurality of pairs of burner ports, wherein one of the burner ports in each pair is positioned above another of the burner ports.

10. The gas burner assembly of claim 1 wherein the number of main burner ports equals the number of second burner ports.

11. The gas burner assembly of claim 10 wherein the second burner ports are aligned radially with the main burner ports.

12. The gas burner assembly of claim 1 comprising additionally secondary main burner ports formed on the radially outward facing surface of the main burner adjacent to the main burner ports.

13. The gas burner assembly of claim 1 wherein the main burner and the second burner are formed together as an integrated piece.

14. A stacked dual gas burner assembly, comprising:

(a) a main burner including a main burner ring having a main burner radius, a plurality of main burner ports extending radially through the main burner ring, and a main burner cover enclosing a top of the main burner ring;

(b) a second burner including a second burner ring having a second burner radius, a circumferential channel formed in the second burner ring and opening downward therefrom, and a plurality of second burner ports extending radially through a portion of the second burner ring so as to be in fluid communication with the circumferential channel and opening on an outwardly facing surface of the second burner ring, wherein the second burner is positioned coaxially with and below the main burner in the gas burner assembly, and wherein the second burner radius is smaller than the main burner radius such that an overhanging edge of the main burner ring overhangs the second burner ring adjacent to the second burner ports to provide recirculation underneath the overhanging edge to stabilize flames produced from the second burner ports to help maintain flame attachment at the second burner ports;

(c) a distribution ring having a distribution ring channel formed therein and opening radially upward therefrom and a fuel aperture formed therein in fluid communication with the distribution ring channel, wherein the distribution ring is positioned coaxially with and below the second burner in the gas burner assembly such that the distribution ring channel is in fluid communication with the circumferential channel formed in the second burner ring; and (d) a base portion having main and second fuel conduits formed therein, wherein the distribution ring is positioned on the base portion such that the base portion, distribution ring, second burner ring, main burner ring, and main burner cover define a main fuel chamber and such that the main fuel conduit is in fluid communication with the main fuel chamber and the second fuel conduit is aligned with the fuel aperture formed in the distribution ring such that the second fuel conduit is in fluid communication with the distribution ring channel.

15. The gas burner assembly of claim 14 wherein the main burner cover has a main burner cover radius which is larger than the main burner radius such that an edge of the main burner cover extends radially outward over the main burner ring.

16. The gas burner assembly of claim 14 wherein the main burner ring overhangs the second burner ring by approximately ⅛ of an inch.

17. The gas burner assembly of claim 14, comprising additionally means for providing separately controllable flows of gas to each of the main fuel conduit and the second fuel conduit.

18. The gas burner assembly of claim 17 wherein the means for providing a flow of gas to the main fuel conduit includes means for providing a partially pre-mixed gas-air mixture to the main fuel conduit.

19. The gas burner assembly of claim 17 wherein the means for providing separately controllable flows of gas to each of the main fuel conduit and the second fuel conduit includes means for providing a flow of gas to the main fuel conduit and to the second fuel conduit but not to both the main and second fuel conduits simultaneously.

20. The gas burner assembly of claim 17 wherein the means for providing separately controllable flows of gas to each of the main fuel conduit and the second fuel conduit includes a two stage-valve.

21. The gas burner assembly of claim 14 wherein the main burner ports are round and the second burner ports are round.

22. The gas burner assembly of claim 14 wherein the main burner ports are round and the second burner ports are slot shaped.

23. The gas burner assembly of claim 14 wherein the second burner ports include a plurality of pairs of burner ports, wherein one of the burner ports in each pair is positioned above another of the burner ports in each pair.

24. The gas burner assembly of claim 14 wherein the number of main burner ports equals the number of second burner ports.

25. The gas burner assembly of claim 14 wherein the second burner ports are aligned radially with the main burner ports.

26. The gas burner assembly of claim 14 comprising additionally secondary main burner ports formed on the radially outward facing surface of the main burner adjacent to the main burner ports.

27. The gas burner assembly of claim 14 wherein the distribution ring channel in the distribution ring includes a sloping floor for providing proper gas distribution therein.

28. The gas burner assembly of claim 14 wherein the main burner ring and the second burner ring are formed together as an integrated piece.

* * * * *